United States Patent [19]

Weigel et al.

[11] Patent Number: 4,919,412

[45] Date of Patent: Apr. 24, 1990

[54] CONTROL SYSTEM FOR A DRAW-OFF SYSTEM FOR SHEET MATERIAL

[75] Inventors: Peter Weigel, Borchen-Doerenhagen; Guenter Holland-Letz, Paderborn-Elsen; Heinz Ademmer, Geseke; Ulrich Nottelmann, Bad Driburg, all of Fed. Rep. of Germany

[73] Assignee: Nixdorf Computer AG, Paderborn, Fed. Rep. of Germany

[21] Appl. No.: 161,692

[22] Filed: Feb. 29, 1988

[30] Foreign Application Priority Data

Mar. 3, 1987 [DE] Fed. Rep. of Germany ..... 3706810

[51] Int. Cl.[5] ..... B65H 7/08

[52] U.S. Cl. ..... 271/110; 271/152

[58] Field of Search ..... 271/110, 35, 38, 30.1, 271/114, 126, 131, 133, 165, 166, 152, 153, 154; 221/277, 231

[56] References Cited

U.S. PATENT DOCUMENTS

| | | | |
|---|---|---|---|
| 3,580,566 | 5/1971 | Vasse | 271/110 |
| 4,302,000 | 11/1981 | Frank | 271/153 |
| 4,317,138 | 2/1982 | Bryan et al. | 271/110 |
| 4,566,685 | 1/1986 | Irvine et al. | 271/152 |
| 4,589,765 | 5/1986 | Perun et al. | 271/152 |
| 4,624,454 | 11/1986 | Grutzmacher et al. | 271/153 |

FOREIGN PATENT DOCUMENTS

| | | | |
|---|---|---|---|
| 3434780 | 9/1984 | Fed. Rep. of Germany . | |
| 10028 | 1/1977 | Japan | 271/126 |
| 51428 | 3/1986 | Japan | 271/110 |

*Primary Examiner*—Joseph J. Rolla
*Assistant Examiner*—Kenneth Noland
*Attorney, Agent, or Firm*—Dykema Gossett

[57] ABSTRACT

A control system for the pressing force created on the draw-off roller system (24) in a single-feed mechanism for sheet material (16) is described. This pressing force has an optimum value when the time required for the respective draw-off operation is the minimum amount. For a corresponding regulation, a time measurement is performed with successive draw-off operations. The times thus determined are evaluated, and if they are found to be the same, the value of the pressing force reached following regulation of a drive that produces the pressing force is retained.

14 Claims, 1 Drawing Sheet

CONTROL SYSTEM FOR A DRAW-OFF SYSTEM FOR SHEET MATERIAL

TECHNICAL FIELD

The present invention concerns a control system of a draw-off mechanism for sheet material, whereby a stack of sheets is pressed by means of a pressing device against a draw-off roller system which removes the sheet that is in contact with it and sends it to a conveyance path where the pressing force of the pressing device is analyzed as an actual value and is regulated to an optimum value depending on the results of the comparison operation.

BACKGROUND OF THE INVENTION

A control system of the general type described above is disclosed in German Patent (OLS) No. 3,434,780 which is concerned with a device for single feed of bills of currency from a container provided in an automatic money changer. Devices of this type must operate reliably and accurately, and optimum regulation of the pressing force exerted by the pressing device on a stack of currency bills in the container and thus on the draw-off roller system is of crucial importance. With the known control system, the output force of an electric drive motor is regulated, and the drive motor presses a pressure plate against the stack of currency notes in the money holder so the stack of bills is pressed with a given pressing force against the draw-off roller system. This pressing force is measured and is supplied as the actual value to the control circuit.

In this way, the pressing force can be regulated relatively accurately in accordance with a control value as an input value, but such a control value must be determined experimentally and then must always be supplied consistently to the control circuit for certain types and sizes of sheets.

Such a control system functions satisfactorily in draw-off of sheet material whose properties are largely constant within a stack of sheets, i.e., when processing new sheets that are free of folds and are of a uniform quality. In dispensing devices for paper currency, however, such optimum conditions cannot be expected and so the control value used for the type of control system known in the past is never optimum for each individual stack of paper currency, so errors in feed that can be attributed to too little or too much pressure against the draw-off roller system are unavoidable.

SUMMARY OF THE INVENTION

The object of the present invention is to provide a control system that will operate with a control value that is always optimum and is not determined experimentally but instead is obtained by analyzing the respective draw-off process.

This problem is solved for a control system of the type defined initially, according to this invention by the fact that the comparative value for the pressing force is derived from a comparison of the times needed for at least two draw-off operations during a control process, and if these times match, this is taken as a criterion for achieving an optimum pressing force.

This invention is based on recognition of the fact that there is a relationship between the optimum pressing force of a stack of sheets against the draw-off roller system and the time required for a draw-off process. If this time assumes a minimum value during successive draw-off operations without resulting in double feed, then the optimum pressing force has been achieved. This has been determined in long-term operation of a wide variety of feed mechanisms handling a wide variety of sheet materials. Thus, optimum draw-off operation (i.e., free of errors) at a given draw-off roller speed is advantageously also associated with the greatest draw-off rate. If the control system according to this invention is used, then there is an automatic adaptation of the pressing force to the draw-off roller system so a wide variety of different types of sheet materials can be separated for single feed. This also proves to be an important improvement especially in using money dispensing machines.

The time required for a given draw-off process is measured between the beginning of the draw-off process and the passage of the sheet drawn off past a sensor provided along the conveyance path. One example of a sensor that can be used here is a light sensor such as those used in conveyance devices for sheet materials for monitoring the conveyance process. With a control system according to this invention, at lest two time period must always be analyzed to determine whether they match, so the distance between the sensor and the draw-off point is not critical for the time analysis. However, it is advantageous if the sensor is a distance away from the draw-off point that corresponds at least to the length of a page, because then a more accurate time analysis is possible.

The activation of the draw-off roller drive is an expedient criterion for the beginning of the draw-off operation. Since the operation of the draw-off rollers must be switched on or off for each sheet that is to be fed, the use of the activation signal with which an electromagnetic coupling for the draw-off rollers is switched, for example, can easily be used as the starting signal for the time measurement.

BRIEF DESCRIPTION OF THE DRAWINGS

A practical example of this invention is described below with references to the figures, using a money dispensing machine. The figures show the following.

DESCRIPTION OF THE PREFERRED EMBODIMENTS

Figure 1:
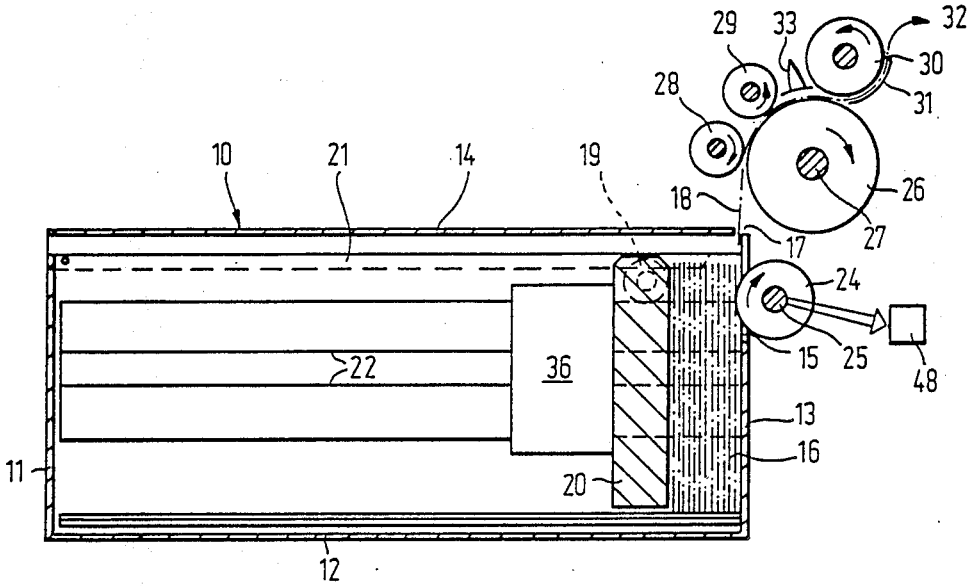
FIG. 1 is a schematic sectional view of a container for paper currency with the respective draw-off roller system and conveyor roller system.

FIG. 1 shows a paper currency container 10 in longitudinal section such as one used in a money dispensing machine. Furthermore, this paper currency container 10 is also coordinated with a draw-off roller 24 and conveyor rolls 26, 28, 29 and 30 as shown schematically. These rolls belong to a money dispensing machine (not shown) in which the paper currency container 10 is used. A money dispensing machine may have several arrangements of the type shown in FIG. 1 either side by side or one above the other.

The paper currency container 10 has a rear wall 11, a bottom 12, a front wall 13 and a cover surface 14. The paper currency container 10 holds a stack of paper currency 16 which is pressed with a pressing plate 20 against the front wall 13 of the paper currency container 10. The pressing plate 20 can therefore be moved in the paper currency container 10 with a drive 36 carrying it along guide rails 21 and 22. Drive 36 is preferably an electric stepper motor whose operation is regulated in a manner to be described below. FIG. 1 shows the guide rail 21 schematically as a toothed rail on which a pinion 19 that is mounted on pressing plate 20 and driven by a stepper motor 36 is guided. Additional drive elements of such a type may run along guide rails 22 and may also be driven by stepper motor 36. However, this is not shown further in FIG. 1.

The front wall 13 of the paper currency container 10 has draw-off aperture 15 into which a draw-off roller system projects as illustrated with one draw-off roller 24 in FIG. 1. This draw-off roller 24 sits on a drive axle 25 that is connected in a manner not shown here to an electromagnetic coupling by means of which it can be coupled to a roller drive of the money dispensing machine, likewise not shown here.

The paper currency container 10 also has a slit aperture 17 on its front upper edge through which the drawn-off paper currency can be pushed out to the top when the draw-off roller 24 is driven over its drive shaft 25. The draw-off roller thus pushes the paper currency notes of the stack 16 upward one after the other through draw-off slit 17 in accordance with the intermittent operation. This is indicated by a dash-dot line 18 in FIG. 1 which is intended to represent one currency bill. This then enters the area of conveyor roll 26 which is mounted on a drive shaft 27 and is opposite a mating roll 28. The two rolls 26 and 28 cause conveyance of only one currency bill 18 due to their contrarotational circumferential movement. If two bills of currency happen to be drawn off at the same time due to defective draw-off, then one bill will be pushed back by mating roll 28 and stored in a manner not shown here but essentially known for devices of the type in question here. The currency bill 18 that has been drawn off is then conveyed further from conveyor roll 26 on a conveyance pathway, the course of which is determined by two other pressing rolls 29 and 30 as well as by guide plate 31 until paper currency bill 18 is then transferred to a collective conveyance path in the direction 32 diagrammed schematically in FIG. 1.

A sensor 33 is provided between pressure rolls 29 and 30, which may be a light sensor, for example. With this sensor, the passage of each bill of currency is noted. A signal produced by the sensor 33 is used in regulation of stepper motor 36 in a manner yet to be described.

The drive axle 25 of draw-off roller 24 is coupled to a force measurement device 48 as indicated schematically by an arrow in FIG. 1 and this force measurement device measures the pressing force exerted by stepper motor 36 on draw-off roller 24 by way of pressure plate 20 and currency stack 16. The draw-off process requires a pressing force that must be in a predetermined range in order to prevent double feed on the one hand while on the other hand assuring orderly and error-free draw-off of individual sheets. Since a wide variety of sheet properties may be encountered, especially in single feed of paper currency, it is extremely important for an optimum pressing force to be maintained.

Figure 2:
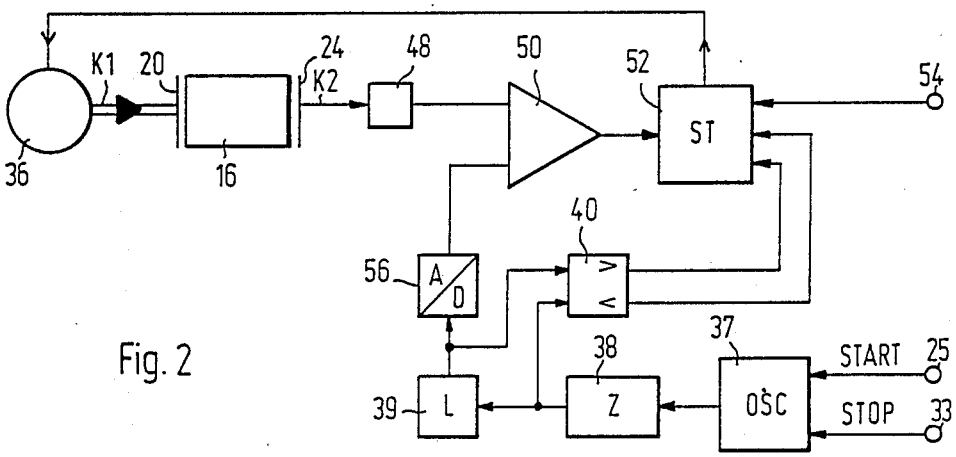
FIG. 2 is a block diagram of the pressure regulating system used in the arrangement according to FIG. 1.

FIG. 2 shows a control system with which it is possible to keep the pressing force exerted by a stepper motor 36 at a level that is optimum for each stack of sheets or each stack of currency bills. A control circuit for stepper motor 36 is shown, and gives off an output force K1 and transfers this to the stack 16 of sheets by way of pressing plate 20 which is shown schematically. The stack of sheets in turn exerts a pressing force on the draw-off roller 24 which is shown schematically and is analyzed in the form of a pressing force K2 by the force measurement device 48. This pressing force K2 can be reduced by the amount of frictional losses of the stack of paper currency and the pressing drive in comparison with the starting force K1 of stepper motor 36. The force signal emitted by the force measurement device 48 may have an electric amplitude whose value is between the value of the operating voltage of the control system shown in FIG. 2 and the value of the reference potential. This value is compared with a reference value in an analog comparator 50 and the results of the comparison are sent to a control system 52 which controls the stepper motor 36 accordingly.

The comparative value is formed from an assumed optimum value of the pressing force K2 which is loaded into an intermediate storage 39 as a digital value with the insertion of the currency container 10 into the money dispensing machine. This digital value is converted to an analog value in a digital/analog converter 56 and then is sent to the analog comparator 50. What this accomplishes is that the setting of the assumed optimum value of pressing force K2 takes place before the first draw-off process.

Control of the pressing force K2 during the following draw-off operations is implemented as follows.

The start-up signal for the electromagnetic coupling (not shown in FIG. 1) by means of which the drive axle 25 of the draw-off roller 24 can be coupled to the machine drive is sent as the start signal to a counting pulse generator 37. The corresponding input of this counting pulse generator 37 is designated as 25 in order to show the operative connection with the draw-off roller system. With the beginning of each draw-off process, the counting pulse generator 37 is thus started up. A stop input of the counting pulse generator 37 receives a signal from the sensor 33 when the front edge of a drawn off currency bill 18 passes by it in the conveyance arrangement according to FIG. 1. The stop input of the counter pulse generator 37 is designated as 33 accordingly. The counting pulse generator 37 thus gives off counting pulses for a time that is between the beginning of a draw-off operation and the passage of the front edge of the drawn off currency bill 18 past the sensor 33. This number of counting pulses is sent to a counter 38. The counting value reached with the counter 38 can then be sent to a comparator 40 as well as an intermediate storage 39 (latch) in a manner not illustrated further here, e.g., triggered by the signal of the sensor 33. Comparator 40 has two outputs and compares the counting value supplied to it with a counting value obtained from intermediate storage 39 and corresponding either to the assumed optimum value or belonging to a previous draw-off operation. At its outputs, comparator 40 delivers signals that characterize the larger-smaller relationship of its two input signals. The outputs of comparator 40 are designated in FIG. 2 accordingly.

The output signals of comparator 40 are sent to control system 52. They are used to control the direction of rotation of stepper motor 36. If the number of counting pulses counted by counter 38 is larger than the value stored in intermediate storage 39 then comparator 40 gives a larger signal. Then the direction of rotation of stepper motor 36 is controlled in the sense of an increase in the output force K1. The control system 52 delivers a number of pulses fixed in it to stepper motor 36 which corresponds to the change in the output force K1 by a given amount.

After each comparison, the contents of a counter 38 are loaded into intermediate storage 39 and thus serve as the control value for the next following draw-off operation. As a result, the pressing force is increased with each draw-off operation, because with an increase in pressing force, the slippage between the currency bills 18 and the draw-off roller 24 becomes progressively smaller. However, if the pressing force is too high, this has a negative effect on the single feed action of conveyor roll-mating roll pair 26, 28 and this results in double feed. These are detected in a known manner which are therefore not shown separately in FIG. 1 and reported to control system 52 by way of a control input 54.

A double draw-off report is interpreted by control system 52 as a command to reduce the pressing force. Stepper motor 36 is then operated in a direction of rotation that leads to a reduction in the pressing force. The optimum pressing value is reached when the contents of counter 38 and intermediate storage 39 are identical, i.e., there is no larger-smaller report at comparator 40 and there are no double feeds.

With each currency bill 18 drawn off from the stack 16 of bills, the pressing force is reduced by a certain amount. As a result of this, the contents of counter 38 become larger than the contents of intermediate storage 39 after a certain number of currency bills have been drawn off. The pressing force is then reregulated in the manner described above.

We claim:

1. For use in a system for drawing off sheets of materials from a stack thereof, of the type including a pressing device for pressing the stack of sheets against a roller system which successively draws of individual sheets from the stack and feeds each sheet to a conveyance path, an improved method of controlling the force applied to the stack of sheets by the pressing device, comprising the steps of:

(A) measuring the time period required to draw-off a sheet for a fixed predetermined distance from said stack during a draw-off operation by said roller system;

(B) comparing the time period measured in step (A) respectively for two draw-off operations; and (C) controlling the force applied by said pressing device to said stack of sheets based on the comparison performed in step (B), where when the two time periods are equal and compared in step (B), optimum pressure of sheets against the roller system occurs and the force applied by the pressing device remains constant.

2. The method of claim 1, wherein step (C) includes the substep of changing the force applied to said stack of sheets only when the time periods compared in step (B) are not essentially equal.

3. The method of claim 1, wherein step (A) is performed by sensing the commencement of the draw-off operation of one of said sheets, and sensing the instant when said one sheet passes a preselected point in said conveyance path following a draw-off operation in which said one sheet is drawn off said stack.

4. The method of claim 3, wherein step (A) further includes the step of positioning a sensor for sensing passage of said one sheet past said preselected point a distance away from a point at which said one sheet is drawn off said stack which corresponds at least to the length of said one sheet.

5. The method of claim 3, wherein sensing the commencement of said draw-off operation is performed by sensing the activation of said roller system.

6. The method of claim 4, wherein sensing the commencement of said draw-off operation is performed by sensing the activation of said roller system.

7. The method of claim 3, wherein:

step (A) includes the substeps of generating a count between the sensed commencement of said draw-off operation and the sensed instant when said one sheet passes said preselected point, and step (B) includes the substep of comparing the counts generated during said two successive draw-off operations.

8. The method of claim 1, wherein:

step (A) is performed by generating a count during said draw-off operation, and step (B) is performed by comparing the counts generated during said draw-off operations.

9. The method of claim 1, wherein the draw-off operations compared in step (B) are successively occurring draw-off operations.

10. The method of claim 1, wherein:

step (A) includes the step of generating a count corresponding to said measured time period, step (B) includes the steps of storing a count generated for one of said two draw-off operation, and comparing the stored count with the count generated with the other of said two draw-off operations, and step (C) includes the step of producing a control signal for altering the force applied by said pressing device to said stack of sheets, using the result of the comparison of said stored count the count generated with the other of said two draw-off operations.

11. For use with a system for drawing off sheets of material from a stack thereof, of the type including the combination of a draw-off roller system for contacting and successively drawing off individual sheets from said stack and for feeding the individual sheets to a conveyance path, pressing means for pressing said stack of sheets into contact with said roller system, a control system for controlling the magnitude of force applied by said pressing means to said stack, said control system comprising:

means for measuring the respective time period required to draw-off sheets for a fixed predetermined distance from said stack during a draw-off operation by said roller system;

means coupled with said measuring means for comparing two time periods measured by said measuring means;

means responsive to said comprising means for generating control signals related to the result of the comparison performed by said comparing means; and means responsive to said control signals for changing the magnitude of force applied by said pressing means to said stack, where when the two time periods are equal, optimum pressure of sheets against the roller system occurs and the force applied by the pressing means remains constant.

12. The control system of claim 11, wherein said measuring means includes means for sensing commencement of the operation of said roller system during a draw-off operation and means for sensing the passage of one of said sheets past a preselected point along said conveyance path.

13. The control system of claim 11, wherein said measuring means includes means for producing a count corresponding to each of said time periods.

14. The control system of claim 13, wherein said comparing means includes means coupled with said count producing means for storing a count corresponding to one of said time periods, and a comparator for comparing the count stored in said storing means with the count produced by said count producing means during a draw-off operation occurring subsequent to said one time period, said comparator being operable for producing a first control signal if the compared counts are in a first preselected relationship to each other and for producing a second control signal if said compared counts are in a second preselected relationship to each other.

* * * * *